United States Patent [19]

Eastman

[11] 4,352,392

[45] Oct. 5, 1982

[54] MECHANICALLY ASSISTED EVAPORATOR SURFACE

[75] Inventor: George Y. Eastman, Lancaster, Pa.

[73] Assignee: Thermacore, Inc., Lancaster, Pa.

[21] Appl. No.: 220,020

[22] Filed: Dec. 24, 1980

[51] Int. Cl.[3] ..... F28D 15/00

[52] U.S. Cl. ..... 165/104.25; 165/104.26; 165/DIG. 11; 165/104.33; 62/514 R; 62/119

[58] Field of Search ..... 165/105, DIG. 11, DIG. 14, 165/104.25, DIG. 10; 361/385; 357/82; 174/15 HP; 122/366; 62/316, 317, 64, 119, 514 R

[56] References Cited

U.S. PATENT DOCUMENTS

| | | | |
|---|---|---|---|
| 2,643,282 | 6/1953 | Greene | 62/316 X |
| 2,901,893 | 9/1959 | Saltzman | 62/316 X |
| 3,095,255 | 6/1963 | Smith | 165/DIG. 10 |
| 3,838,997 | 10/1974 | Becker et al. | 62/64 X |
| 3,842,596 | 10/1974 | Gray | 165/105 |
| 3,852,806 | 12/1974 | Corman et al. | 357/82 |
| 3,989,095 | 11/1976 | Voboril et al. | 357/82 X |
| 3,999,400 | 12/1976 | Gray | 165/105 |

FOREIGN PATENT DOCUMENTS

| | | | |
|---|---|---|---|
| 464768 | 7/1975 | U.S.S.R. | 165/105 |

OTHER PUBLICATIONS

Hwang et al., U. P. *Evaporation Cooling Module,* IBM Tech. Discl. Bulletin, vol. 21, No. 10, 3/79.

Sachar, K. S. *Integrated Circuit Cooling Device,* IBM Tech. Discl. Bulletin, vol. 19, No. 2, 7/76.

Bahelaar et al., E. J. *Heat Pipe for Chip Cooling,* IBM Tech. Discl. Bulletin, vol. 14, No. 9, 272.

R. A. Freggens, in "Experimental Determination of Wick Properties for Heat Pipe Applications", 4th IECEC, Washington, D.C., Sep. 1969.

*Primary Examiner*—Albert W. Davis, Jr.

*Attorney, Agent, or Firm*—Martin Fruitman

[57] ABSTRACT

A mechanically assisted evaporator layer for use in both open and evacuated heat transfer systems, in which a pump and spray nozzle operate in conjunction with a sintered metal evaporator layer to reduce the temperature difference required to transfer heat across the thickness of the surface and to permit smaller temperature differences and higher power densities in transferring heat. Liquid is pumped to and sprayed from a nozzle onto the sintered metal layer to keep the entire surface wetted at all times so as to permit uniform thin film evaporation from the surface. The continual presence of liquid at the outer evaporative boundary reduces the likelihood of surface dryout while the thermal conductivity of the sintered metal promotes more effective vaporization.

5 Claims, 2 Drawing Figures

MECHANICALLY ASSISTED EVAPORATOR SURFACE

SUMMARY OF THE INVENTION

Evaporator surface applications for high power density frequently result in conflicting engineering goals. R. A. Freggens, in "Experimental Determination of Wick Properties for Heat Pipe Applications" 4th IECEC, Washington, D.C. September 1969, has shown that high power density evaporative sections function well with surfaces of small pores and high thermal conductivity. However, such surfaces usually yield high liquid flow resistance which prevents efficient transfer of heat over large areas. A sintered metal surface, for instance, is ideal for evaporation because of its small pores and high thermal conductivity, but sintered metal pores are so small that, for large areas, the high power density capability is lost due to the high viscous drag of liquid flow through the pores. This causes a severe limitation upon evaporative cooling of the surface because of difficulty in feeding liquid to the entire surface, when, as in a heat pipe, liquid is supplied from one edge of the surface.

Another approach of periodic feeder wicks, wicks oriented perpendicular to the evaporator surface at regular intervals along the surface, to some extent solves the problem of liquid supply to the surface, but, at the same time, aggravates the difficulty by blocking heat transfer from the region where the feeder wick joins the evaporative surface.

A related limitation arises in applications where small temperature differentials exist between the device being cooled and the heat sink to which heat is transferred. In such applications it is desired to utilize thin film surface evaporation rather than nucleate boiling for vapor generation in order to minimize temperature looses. In addition, the temperature difference existing across the liquid thickness of an evaporator layer may be a perceptible portion of the system losses. In such cases, heat transfer impedance through the layer causes the temperature difference and can be minimized by use of a dense porous metal layer with high thermal conductivity, but such a layer increases liquid drag and reduces the supply of liquid to the heated side of the layer.

It is an object of this invention to overcome the problem of high liquid drag in sintered metal evaporator surfaces.

It is a further object of the present invention to furnish an evaporative cooling system which more effectively transfers heat at high power densities from porous evaporative surfaces.

It is a still further objective of the present invention to furnish an improved evaporative cooling system for use in heat transfer systems with small temperature differences.

The objectives of this invention are attained by constructing a capillary evaporator layer of particularly small capillary pores and high thermal conductivity, for instance, one made of sintered metal particles, and spraying liquid onto one side of the surface to assist in distribution of the liquid in the direction parallel to the plane of the surface. The spray is developed by a nozzle fed from a mechanical pump.

One particularly suitable application of the spray fed evaporator layer is in a heat pipe for cooling of high power density surfaces. In such a system portions of the heat pipe other than the evaporator section are constructed of conventional heat pipe means such as a wick within a sealed casing or, if unidirectional heat flow is appropriate for the application, the capillary wick can be omitted and the casing alone used as a condensing surface.

In such an embodiment, the condensed liquid is transported to the inlet side of a mechanical pump and the pump pressure pushes the liquid to the evaporator end of the heat pipe through a spray nozzle which is directed so as to saturate the sintered layer at the evaporator section with the heat transfer liquid. Movement of the liquid from the condensing surfaces to the inlet of the pump can be accomplished by gravity, by capillary action or by any other liquid flow means. The pump spray nozzle and a generous quantity of heat transfer fluid within the heat pipe guarantee that the evaporator layer will not dry out and be damaged. This liquid transport technique can be used either with or without conventional means such as gravity of capillary transport directly to the evaporative layer. The mechanically assisted heat pipe, because it has no limitation due to vapor movement interfering with liquid transfer back to the evaporative section, is particularly well suited for the high power density applications of some of the more sophisticated modern technologies such as cooling of X-ray tubes, electron tube electrodes, plasma arc electrodes, and high power laser mirrors. For instance, the device permits the transfer of heat from a small surface heated by an electronic device and efficiently transfers that heat to larger surfaces, thus in effect acting as a power density transformer, moving heat from a high power density surface to a larger surface area which operates at a lower power density and is cooled by more conventional means.

Other applications of the mechanically assisted evaporator layer include closed system heat transfer devices which do not involve evacuation of non-condensible gases, such as pressurized systems, and also completely open systems.

For applications in open systems, where the cooling liquid is not reclaimed, but is rather continuously fed from a liquid source, the cooling action is accomplished by vaporization of the liquid into the atmosphere. The basic structure and operation of the evaporative cooling layer is, however, the same. Liquid, fed to the exposed surface by spraying from the nozzle is only required to move across the thickness of the surface by capillary action, and the spray, therefore, maintains all portions of the surface full of liquid, regardless of the size of the surface area. With all portions of the surface made of high density, high conductivity material and the full thickness of the surface fully supplied with liquid, very little temperature difference develops between the evaporator outer surface and the heated surface, and the entire cooling system will operate satisfactorily with less temperature difference than conventional cooling systems.

DETAILED DESCRIPTION OF THE PREFERRED EMBODIMENTS

Figure 1:
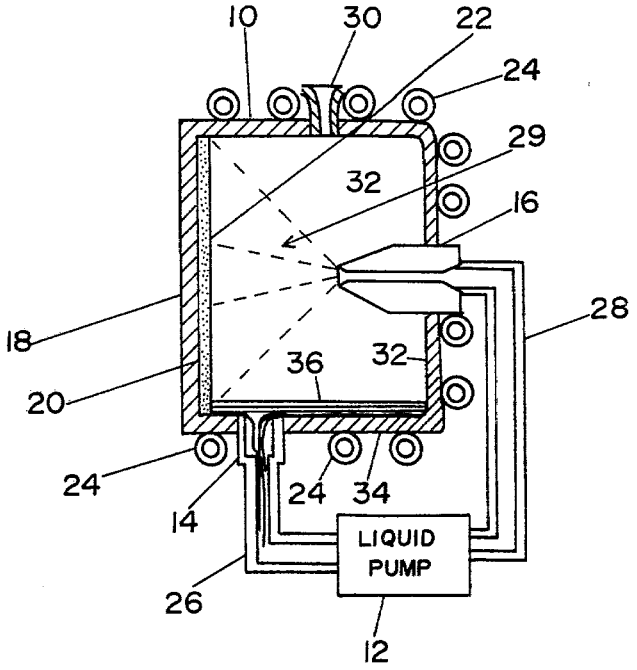
FIG. 1 depicts a cross sectional view of the present invention used as the evaporator section of a heat pipe.

The present invention is depicted in FIG. 1 in conjunction with gravity dependent heat pipe 10 where sintered layer 22, similar in construction to but thinner than a conventional heat pipe wick, pump 12 connected to casing 11 at drain 14, and spray nozzle 16 cooperate to transfer heat from high power density surface 18. High power density surface 18 is heated by some external device not shown. The externally generated heat passes through casing 11 at surface 20 and in turn transfers heat to sintered layer 22 constructed as a thin evaporator layer with high density, high conductivity sintered material. Sintered surface 22 disperses the heat over its volume by its thermal conductivity characteristics. Sintered layer 22 is bonded to the surface of casing 11. Other areas of casing 11 are cooled by conventional cooling pipes 24 in which liquid is flowing. Drain 14 penetrates casing 11 at its lowest point and is connected to pump 12 by inlet line 26. Pump 12 is connected to spray nozzle 16 by means of outlet line 28. Spray nozzle 16 penetrates casing 11 and is directed so that spray 29 will cover the entire back side of sintered layer 22. Vacuum closure 30 penetrates casing 11 to permit evacuation of non-condensable gases from the heat pipe and loading with liquid.

When intense external heat is applied to surface 18 of casing 11 the heat is first conducted through the thickness of the casing to sintered layer 22 and causes evaporation and capillary refilling of the pores nearest surface 18 without dry-out of the exposed surface of sintered layer 22, because of the continuous spray. As with the conventional mechanism of heat transfer within a heat pipe, the vapor moves outward from surface 20 and the liquid moves inward by capillary action toward surface 20 across the thickness of sintered layer 22.

The thermal characteristics of sintered layer 22 are such that it also conducts heat outwardly into contact with the liquid trapped in all its pores to enhance the vaporizing action.

As the vapor leaves the back side of sintered layer 22, it moves, because of differential vapor pressure, to cooled surfaces 32, where it is condensed due to the cooling action of external cooling lines 24. In the embodiment shown, liquid condensing on surfaces 32 runs by gravity down to casing drain 14 and into pump input line 26. Surface 34, however, is shown with capillary fibers 36 bonded to it and extending into inlet line 26. This permits the alternative method of capillary action for transporting condensed liquid to the inlet of pump 12. Liquid entering drain 14 is moved by the mechanical action of pump 12 through the pump and then pushed through pump outlet line 28 into spray nozzle 16. Spray nozzle 16, directed at the back side of sintered layer 22 sprays it with liquid thereby keeping it saturated. The heat transfer cycle is completed as the liquid travels the short distance to the pores nearest casing surface 18 by capillary action as in conventional heat pipes.

Important benefits of the invention are the ability to keep sintered layer 22 saturated with liquid and to overcome with mechanical force the interference with liquid flow by the vapor being emitted from sintered layer 22.

For highest power densities with low temperature differentials across the thickness of sintered layer 22, a thickness of less than three millimeters for sintered surface 22 is desirable. In such a case, spray nozzle 16 should be designed to yield a droplet pattern on sintered layer 22 with droplet edge to edge spacing of less than two millimeters, and both the density and the thermal conductivity of sintered surface 22 should be high. Typically a density of 40 to 60 percent of theoretical density and a pore size of 1 to 25 micron is preferred.

Figure 2:
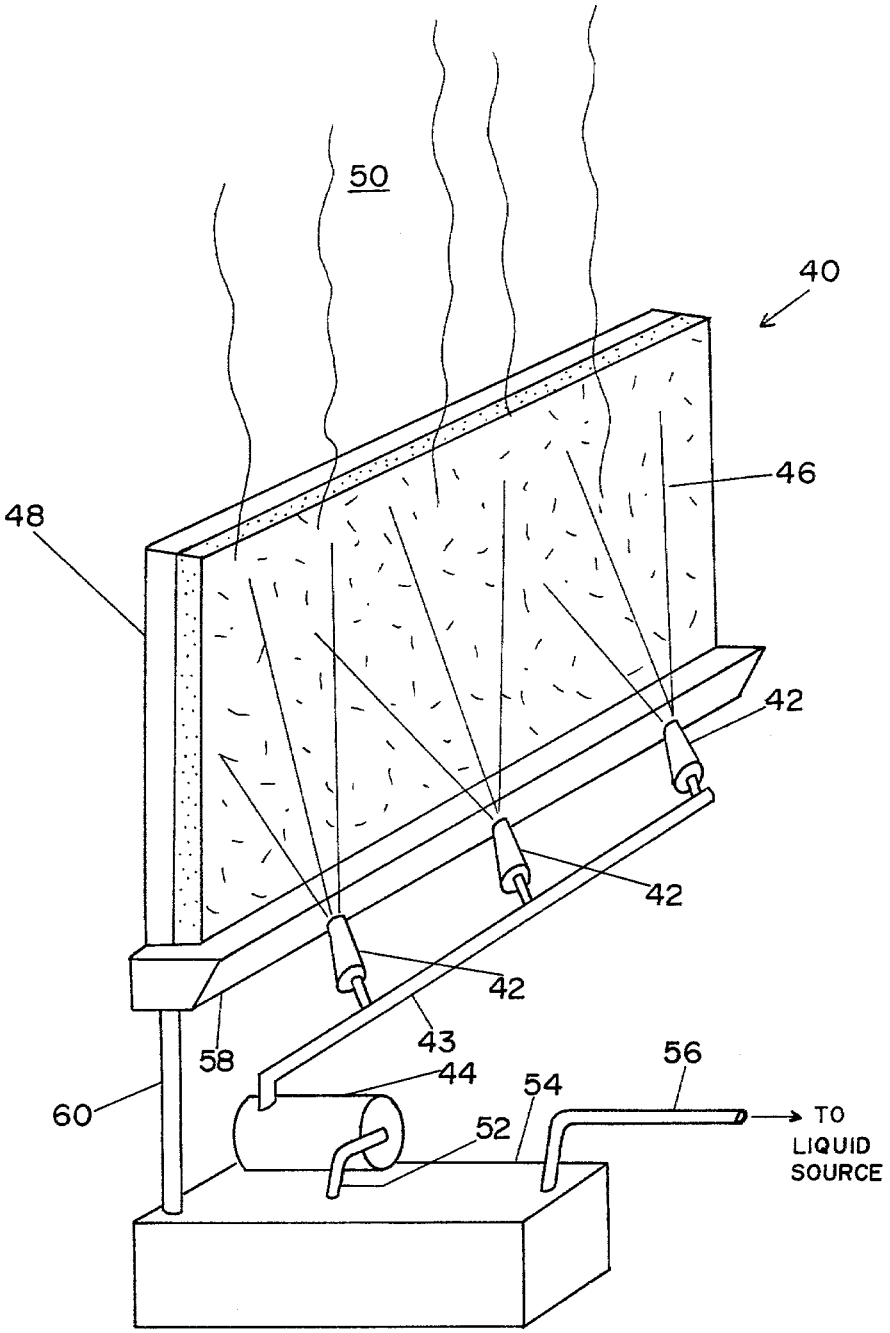
FIG. 2 is a perspective view of a cooling panel using the present invention.

An alternate embodiment of the invention is shown in FIG. 2, where vapor generating cooling panel 40 is sprayed with liquid from several nozzles 42 fed by pump 44. Capillary layer 46 is constructed of dense sintered metal to yield both high thermal conductivity and strong capillary pumping of liquid. Both of these characteristics are omnidirectional, but since heat is supplied at structural panel 48 to which capillary layer 46 is bonded, the heat flow is essentially in the direction from panel 48 to layer 46. Structural panel 48 is itself heated from a heat source (not shown) which could be any common source, such as waste heat from any mechanical, chemical, or electrical process.

Flows within capillary layer 46 are essentially perpendicular to the surface since the complete wetting of layer 46 by spray from nozzles 42 neutralizes capillary forces which would otherwise act parallel to the plane of the surface. Essentially, liquid movement is in toward panel 48 and vapor moves out toward the exposed surface of capillary layer 46. Once free of the surface, vapor 50 rises in the atmosphere.

Nozzles 42 are fed by pump 44 by means of manifold 43. Pump 44 draws liquid through pipe 52 from tank 54. Tank 54 is originally filled and replenished through pipe 56 from a liquid source (not shown). Since an excess of liquid will, however, be sprayed onto surface 46, drip pan 58 is used to catch the runoff and return it to tank 54 by means of pipe 60.

It is to be understood that the forms of this invention shown and merely preferred embodiments. Various changes may be made in the function and arrangement of parts; equivalent means may be substituted for those illustrated and described; and certain features may be used independently from others without departing from the spirit and scope of the invention as defined in the following claims.

For example, in a heat pipe embodiment more than one spray nozzle may also be supplied from the pump, each nozzle serving to saturate a different area of the sintered surface. Moreover, the capillary layer need not be planar, and could be the outside surface of a pipe or the surfaces of a group of tubes within a heat exchanger.

What is claimed as new and desired to be secured by Letters Patent of the United States is:

1. An evaporative cooling system comprising:

a heat conductive capillary layer of less than three millimeters in thicknesses to which heat is supplied for dissipation by evaporative cooling; and spraying means oriented to spray liquid upon and saturate the capillary layer with liquid.

2. An evaporative cooling system as in claim 1 wherein the spraying means produces a pattern of droplets with droplet edge to edge spacing of less than two millimeters.

3. A heat pipe comprising:

an outer casing forming a vacuum tight enclosure;

a heat conductive capillary layer of less than three millimeters in thickness in intimate surface contact with the inside of that part of the outer casing subject to heat input and acting as the evaporator section of the heat pipe;

spraying means oriented to spray liquid upon the portion of the capillary layer in contact with the part of the casing subject to heat;

a condensing means within the enclosure;

a liquid transport means to move condensed liquid from the condensing means to the inlet side of the spraying means; and heat transfer liquid in sufficient quantity to saturate the capillary layer and fill the spraying means and liquid transport means.

4. A heat pipe as in claim 3 wherein the liquid transport means is a capillary feed means to supply liquid to the spraying means.

5. A heat pipe as in claim 3 wherein the spraying means produces a pattern of droplets with droplet edge to edge spacing of less than two millimeters.

* * * * *